US007256342B2

(12) United States Patent
Hagiwara et al.

(10) Patent No.: US 7,256,342 B2
(45) Date of Patent: Aug. 14, 2007

(54) SOUND PICKUP DEVICE FOR PERCUSSION INSTRUMENT

(75) Inventors: Takashi Hagiwara, Yokohama (JP); Kengo Oyama, Hamamatsu (JP); Masako Fukunaka, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 10/828,192

(22) Filed: Apr. 21, 2004

(65) Prior Publication Data

US 2004/0211310 A1 Oct. 28, 2004

(30) Foreign Application Priority Data

Apr. 25, 2003 (JP) ..... P2003-122107

(51) Int. Cl.
*G10H 3/18* (2006.01)

(52) U.S. Cl. ..... 84/726; 84/411 R; 84/723; 84/725; 84/730; 84/743

(58) Field of Classification Search ..... 84/726, 84/730, 723, 477 R, 725, 453, 743, 414, 84/411 R
See application file for complete search history.

(56) References Cited

U.S. PATENT DOCUMENTS 2,495,451 A * 1/1950 Gladstone ..... 84/411 R
2,716,370 A * 8/1955 Sano ..... 84/723
2,900,453 A * 8/1959 Cammack ..... 381/355
3,509,264 A * 4/1970 Green ..... 84/725
3,551,580 A * 12/1970 Glenn et al. ..... 84/723
3,553,339 A * 1/1971 Dominguez et al. ..... 84/725
3,659,032 A * 4/1972 May ..... 84/600
3,668,296 A * 6/1972 Criscuolo ..... 84/414
3,725,561 A * 4/1973 Paul ..... 84/726
3,748,367 A * 7/1973 Lamme et al. ..... 84/679
3,801,943 A * 4/1974 Bertagni ..... 371/398

(Continued)

FOREIGN PATENT DOCUMENTS

DE 23 16 000 11/1975

(Continued)

OTHER PUBLICATIONS

Google Search: "define: electroacooustic transducer", © 2005 Google, http://www.google.com/search?hl=en&lr=en &rls=GGLD%2CGGLD%3A2004-30%2CGGLD%3Aen &q=define%3A+electroacoustic+transducer.*

(Continued)

*Primary Examiner*—Lincoln Donovan
*Assistant Examiner*—Christina Russell
(74) *Attorney, Agent, or Firm*—Dickstein, Shapiro, LLP.

(57) ABSTRACT

A sound pickup device, which is arranged in proximity to a percussion instrument (e.g., a bass drum), comprises a diaphragm stretched under tension over an opening of a shell having a cylindrical shape, and an electroacoustic transducer arranged inside of the shell. The electroacoustic transducer comprises a magnetic transducer or a speaker unit. Herein, the percussion instrument is played to produce the low-pitch sound, which is transmitted to the diaphragm to vibrate so that the electroacoustic transducer is activated to convert the low-pitch sound into an electric signal, based on which the low-pitch sound is reproduced by a sound system with a high fidelity to the original sound.

5 Claims, 4 Drawing Sheets

U.S. PATENT DOCUMENTS

| | | | | | |
|---|---|---|---|---|---|
| 3,956,956 | A | * | 5/1976 | Bertholf | 83/345 |
| 4,168,646 | A | * | 9/1979 | May | 84/723 |
| 4,184,398 | A | * | 1/1980 | Siegelman | 84/725 |
| 4,201,107 | A | * | 5/1980 | Barber et al. | 84/743 |
| 4,242,937 | A | * | 1/1981 | Pozar | 84/725 |
| 4,271,745 | A | * | 6/1981 | Shatto | 84/402 |
| 4,290,332 | A | | 9/1981 | Schoeffling, Jr. | |
| 4,570,522 | A | * | 2/1986 | May | 84/723 |
| 4,669,349 | A | * | 6/1987 | Hyakutake | 84/730 |
| 4,679,479 | A | * | 7/1987 | Koyamato | 84/743 |
| 4,742,753 | A | * | 5/1988 | Speed | 84/414 |
| 4,837,836 | A | * | 6/1989 | Barcus | 381/118 |
| 4,947,725 | A | * | 8/1990 | Nomura | 84/723 |
| 4,984,498 | A | * | 1/1991 | Fishman | 84/730 |
| 5,036,742 | A | * | 8/1991 | Youakim | 84/411 R |
| 5,042,356 | A | * | 8/1991 | Karch | 84/725 |
| 5,056,400 | A | * | 10/1991 | Wachi et al. | 84/600 |
| 5,056,403 | A | * | 10/1991 | Yamashita | 84/723 |
| 5,134,920 | A | * | 8/1992 | Clark | 84/730 |
| 5,345,037 | A | * | 9/1994 | Nordelius | 84/730 |
| 5,430,245 | A | * | 7/1995 | Rogers | 84/725 |
| 5,583,307 | A | * | 12/1996 | Tobia, Jr. | 84/411 R |
| 5,585,581 | A | * | 12/1996 | Rogers | 84/414 |
| 5,627,336 | A | * | 5/1997 | Stevens | 84/746 |
| 6,121,528 | A | * | 9/2000 | May | 84/411 R |
| 6,794,569 | B2 | * | 9/2004 | Kamijima et al. | 84/746 |
| 6,982,376 | B2 | * | 1/2006 | Wise | 84/600 |
| 2003/0070533 | A1 | * | 4/2003 | Ezbicki | 84/411 R |
| 2003/0188629 | A1 | * | 10/2003 | Suenaga | 84/723 |
| 2004/0134332 | A1 | * | 7/2004 | Kamijima et al. | 84/411 R |
| 2006/0021495 | A1 | * | 2/2006 | Freitas | 84/723 |
| 2006/0272490 | A1 | * | 12/2006 | May | 84/743 |

FOREIGN PATENT DOCUMENTS

| | | |
|---|---|---|
| DE | 92 00 097.5 | 5/1992 |
| DE | 196 25 570 | 1/1998 |
| JP | 59-11579 | 1/1984 |
| JP | 11-173876 | 7/1999 |
| JP | 2002-535725 | 10/2002 |
| WO | WO 94/16433 | 7/1994 |

OTHER PUBLICATIONS

Google Search: "define: mesh", © 2005 Google, http://www.google.com/search?sourceid=navclient&ie=UTF-8&rls=GGLD,GGLD:2004-30,GGLD:en&q=define%3A+mesh.*

German office action issued Jun. 7, 2005 with English translation of relevant portions.

English translation of relevant portion- of Japanese Office Action issued May 16, 2006.

* cited by examiner

SOUND PICKUP DEVICE FOR PERCUSSION INSTRUMENT

BACKGROUND OF THE INVENTION

1. Field of the Invention

This invention relates to sound pickup devices for picking up low-pitch sounds produced by striking percussion instruments, in particular, bass drums, with drumsticks or beaters.

This application claims priority on Japanese Patent Application No. 2003-122107, the content of which is incorporated herein by reference.

2. Description of the Related Art

In general, a drum set (or a drum kit) comprises various percussion instruments such as a bass drum, a snare drum, a tom-tom, and/or cymbals, all of which are arranged around a player who gives a rhythm performance using these percussion instruments. Specifically, high-pitch sounds in a high register are produced using 'metal' percussion instruments such as cymbals; intermediate-pitch sounds in an intermediate register are produced using the snare drum and tom-tom; and low-pitch sounds in a low register are produce exclusively using the bass drum, which plays an important role for imparting grand impressions to a musical tune being played. In particular, low-pitch sounds (or low-register sounds) are very important in various types of musical tunes because they form the basis for the melody and rhythm in the musical performance. For this reason, various attempts have been made to improve sound quality and to increase volume with respect to low-pitch sounds. In the case of the bass drum, a drumhead is stretched under tension over an opening of a large-diameter shell so as to decrease resonance frequencies and to increase volume. However, in consideration of the musical performance being performed on a stage, the exterior size and shape of the bass drum should be adequately adjusted in dimensions to coordinate with other instruments.

Generally speaking, human listeners have a keen sense of hearing with respect to intermediate-pitch sounds, whereas they have a relatively low sense of hearing with respect to high-pitch sounds and low-pitch sounds compared with intermediate-pitch sounds; in particular, they may have difficulties in hearing low-pitch sounds. For this reason, various methods have been developed to intentionally enhance the production of the sound of the bass drum. The most classical method provides so-called dual performance in which double bass drums of the same specification and standard are arranged opposite to each other, wherein a primary bass drum is played to produce sound, with which a secondary bass drum resonates. However, such dual performance is disadvantageous in that it requires a relatively large space for installation of double bass drums and it therefore degrades appearance, and it does not always demonstrate superior effects in spite of a relatively large sum invested therein.

A generally known method that is currently a leading technique and is designed as shown in FIG. 4 in which a microphone P is arranged in proximity to a drumhead of a bass drum B, which is disclosed in Japanese Utility Model Application Publication No. Sho 59-11579, for example. That is, the microphone P picks up the sound produced by the bass drum B so as to convert it into electric signals, which are amplified by an amplifier A to activate a speaker system S to reproduce the sound.

In the aforementioned system of FIG. 4, the vibration of the drumhead of the bass drum B is transmitted to a diaphragm of the microphone P having a very small diameter, by which the sound of the bass drum B is converted into electric signals. Hence, it is very difficult to accurately pick up low-pitch sounds having specific characteristics of the bass drum B. Normally, the bass drum B instantaneously produces low-pitch sound which is a massive displacement accompanied wind pressure, whereas the microphone P merely picks up basic components of sound, and it is therefore very difficult to pick up the low-pitch sounds having massive displacement and force. When the low-pitch sound picked up by the microphone is reproduced using an electric circuit, an unnatural sound differing from the original sound may be emphasized so that the reproduced sound may greatly differ from the original sound of the bass drum.

SUMMARY OF THE INVENTION

It is an object of the invention to provide a sound pickup device that can accurately pick up the sound of a percussion instrument (e.g., a bass drum), whereby even when the pickup sound is reproduced through an electric circuit, it is possible to reproduce a sound having a high fidelity to the original sound of the percussion instrument. Thus, it is possible to emphasize the low-pitch sound produced by the percussion instrument without causing incorrect audition.

A sound pickup device of this invention is constituted such that a diaphragm is stretched under tension over an opening of a shell having a cylindrical shape arranged in proximity to a percussion instrument (e.g., a bass drum), wherein a electroacoustic transducer is arranged inside of the shell to convert low-pitch sounds, which are produced by playing the percussion instrument and are transmitted to the diaphragm, into electric signals. Herein, the electroacoustic transducer comprises a magnetic transducer or a speaker unit; and the diaphragm is made of a mesh material or a porous material.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

Figure 1:
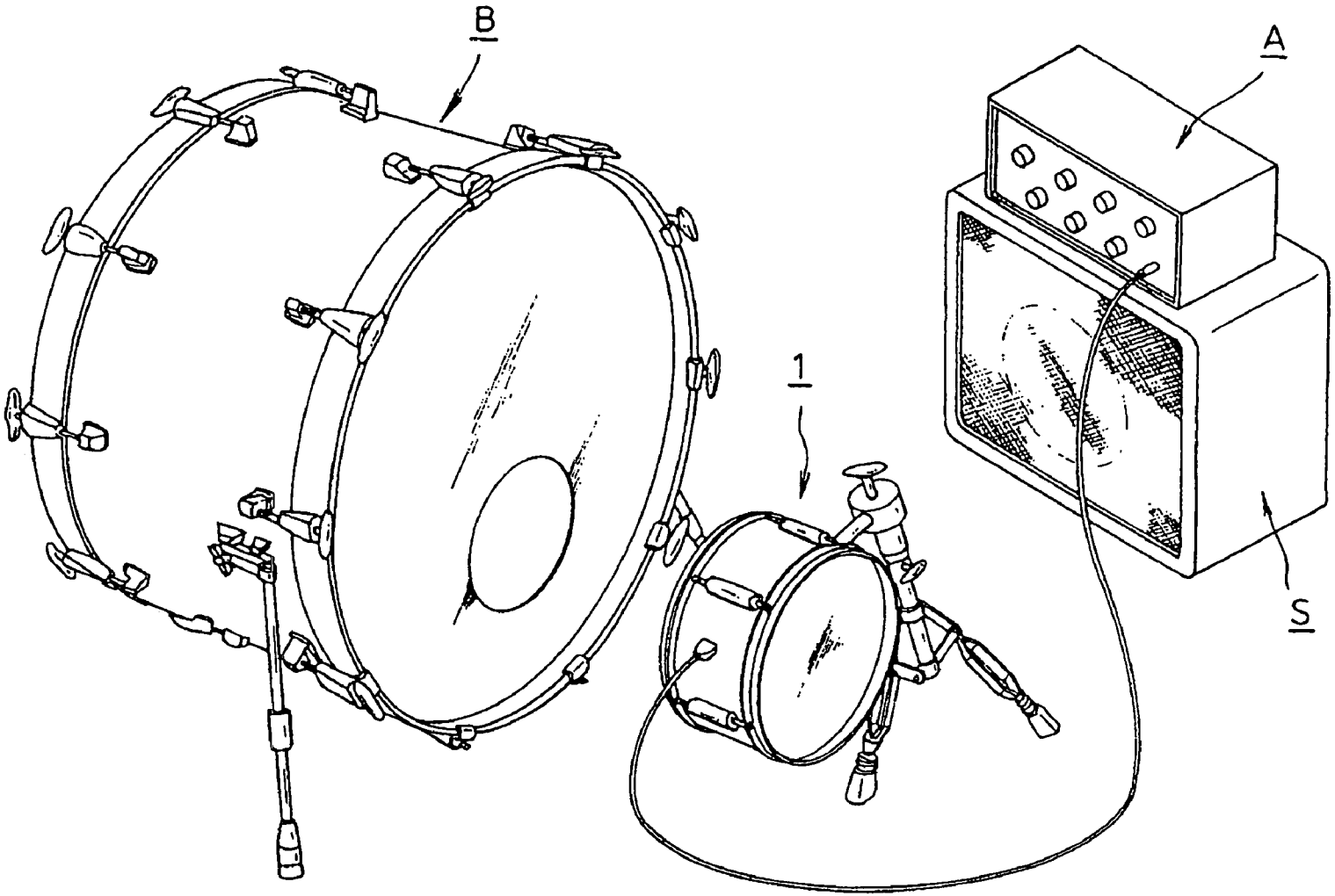
FIG. 1 is a perspective view showing a sound pickup device that is arranged in proximity to a bass drum to pick up sound in accordance with this invention.
Figure 2:
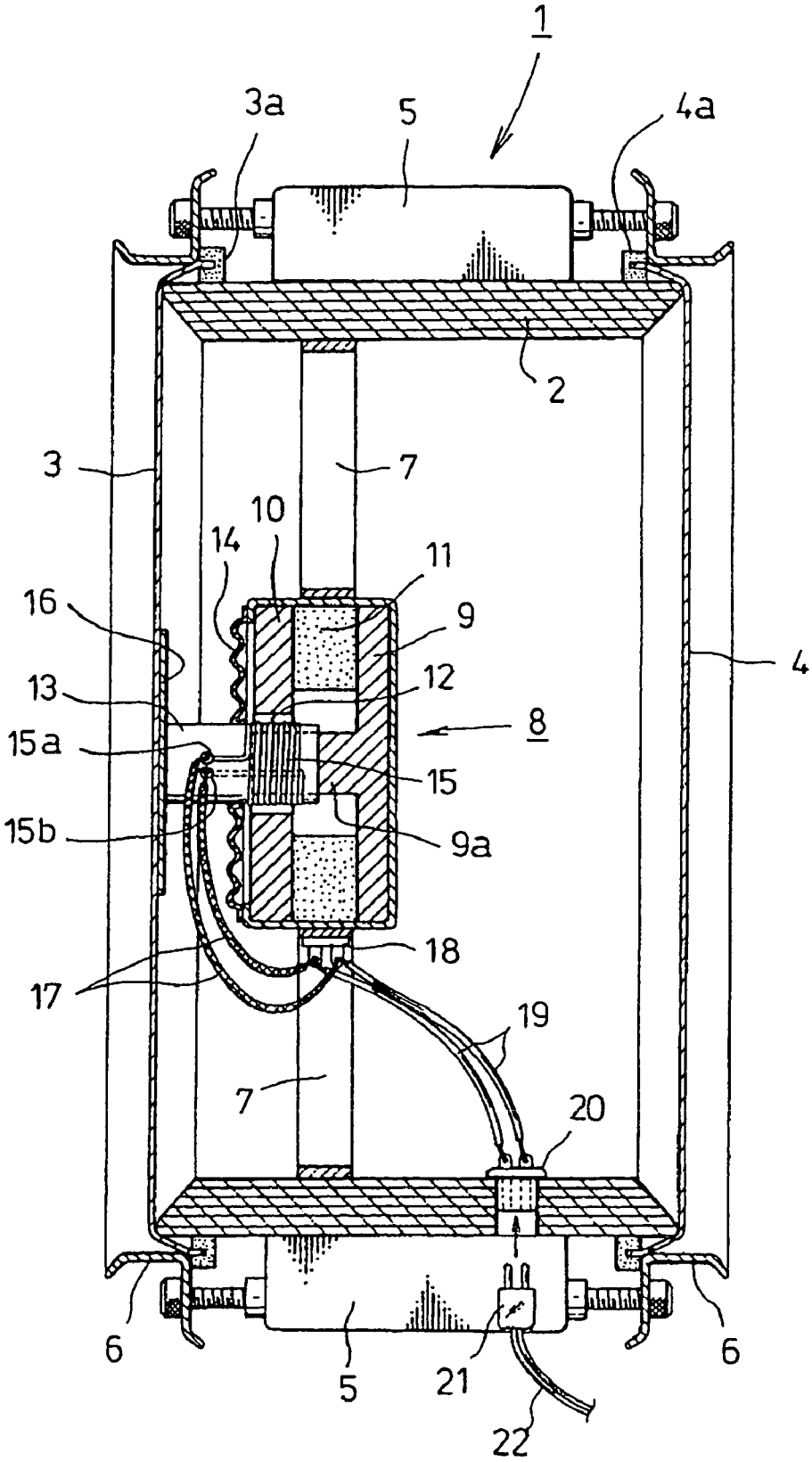
FIG. 2 is a cross sectional view showing the detailed constitution of the sound pickup device using a magnetic transducer in accordance with a first embodiment of the invention.

FIG. 1 shows the overall system constitution in which a sound pickup device 1 is arranged to accompany a percussion instrument (i.e., a bass drum B) in accordance with this invention. FIG. 2 is a cross sectional view showing the detailed constitution of the sound pickup device 1 in accordance with a first embodiment of the invention, wherein reference numeral 2 designates a shell having a cylindrical shape, which forms the main body of the sound pickup device 1. Similar to the generally known constitution of a drum, the shell 2 is formed by laminating wood; alternatively, it can be formed using a metal material, for example.

Diaphragms 3 and 4 resonating with low-frequency sounds are each stretched under tension over openings of the shell 2, wherein they are not limited to a specific material; hence, they can be made of the known material normally used for drumheads. Frame members 3*a* and 4*a* are respectively fixed to outer circumferences of the openings of the shell 2, wherein they are stretched in response to angles of hoops 6, which are adjusted in heights by using lugs 5, which are fixed at prescribed positions on the exterior circumferential wall of the shell 2. Herein, the stretching of the diaphragms 3 and 4 can be adjusted by using the lugs 5, which allows resonate points to be arbitrarily adjusted.

The sound pickup device 1 is equipped with a magnetic transducer 8 that is arranged at approximately the center inside of the shell 2 and that is fixedly supported by one end of a stem 7, the other end of which is fixed to the interior circumferential wall of the shell 2. The magnetic transducer 8 operates inversely to the generally known speaker unit; that is, the magnetic transducer 8 inputs mechanical vibration so as to convert it into electric currents. Specifically, the magnetic transducer 8 is constituted such that a magnet 11 is held between a base yoke 9, integrally equipped with a center pole 9*a*, and a plate yoke 10, thus a magnetic gap 12 is formed between the center pole 9*a* and the yoke plate 10. Herein, a magnetic circuit is formed by magnetic force of the magnet 11 so that a magnetic field is produced in the magnetic gap 12. The aforementioned constitution of the magnetic transducer 8 is equivalent to a so-called external magnetic type, which can be changed to an internal magnetic type by modifying the magnetic transducer 8 such that the center pole 9*a* is formed by a magnet.

Reference numeral 13 designates a coil bobbin, supported by damper 14, one end of which is wound by a voice coil 15 that is positioned in the aforementioned magnetic gap 12. The end of the coil bobbin 13 is bonded and fixed onto the diaphragm 3 via a pad 16. Ends 15*a* and 15*b* of the voice coil 15 wound about the coil bobbin 13 are respectively connected with gold thread lines 17, which are further connected with leads 19 at terminals 18; and the leads 19 are connected with a socket 20. The socket 20 is connected with a connector 21 connected with a cable 22, through which signals output from the magnetic transducer 8 can be transmitted to an external device (not shown).

The aforementioned sound pickup device 1 of the first embodiment is arranged in front of the bass drum B as shown in FIG. 1. When the bass drum B is played to produce the low-pitch sound, the diaphragm 3 resonates with the low-pitch sound so that the coil bobbin 13 wound by the voice coil 15 vibrates in the magnetic gap 12, wherein electric signals are produced due to electromagnetic conversion and are then transmitted to the external device via the socket 20 and the connector 21.

The aforementioned electric signals output from the magnetic transducer 8 normally drives the amplifier A shown in FIG. 1, so that the speaker system S reproduces the low-pitch sound. Alternatively, electric signals output from the magnetic transducer 8 can be lead to a recording system (not shown) by which sounds of the bass drum played in the rhythm performance (or band performance) are recorded.

Figure 3:
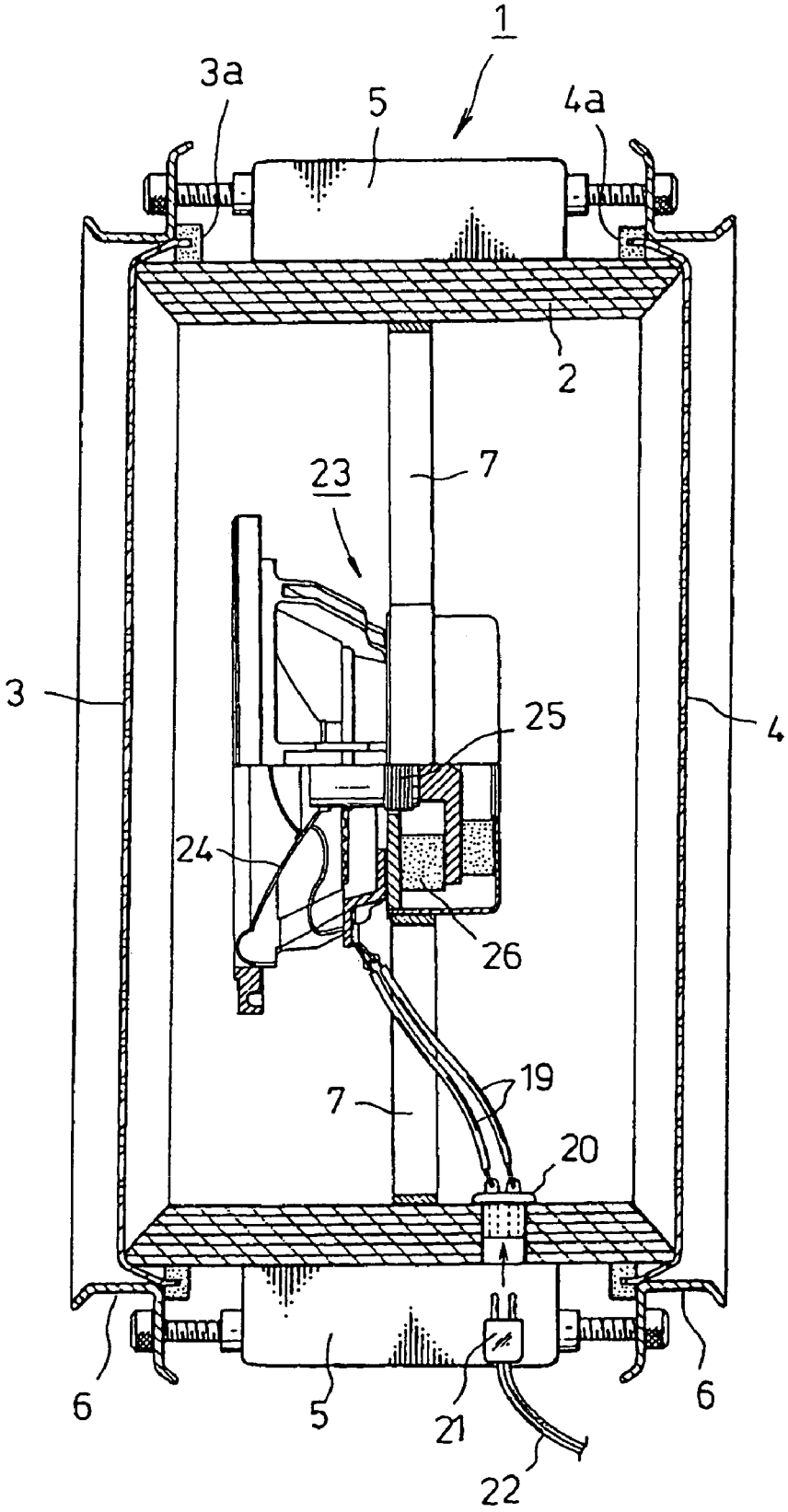
FIG. 3 is a cross sectional view showing the detailed constitution of the sound pickup device using a speaker unit in accordance with a second embodiment of the invention.
Figure 4:
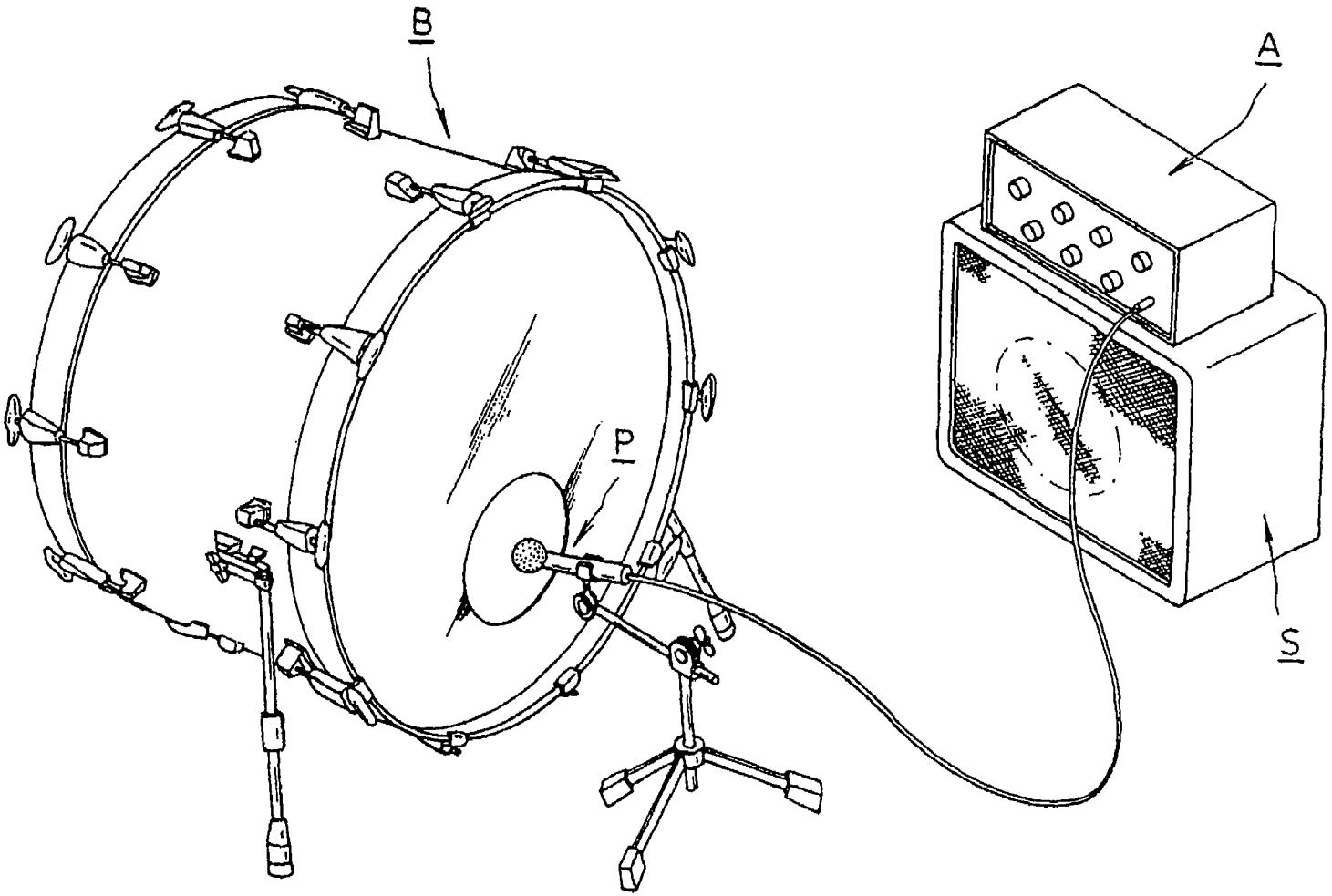
FIG. 4 PRIOR ART
FIG. 4 is a perspective view showing the overall constitution of the conventionally known sound pickup system accompanied with a bass drum, an amplifier, and a sound system.

FIG. 3 shows a second embodiment of the sound pickup device 1 in which the magnetic transducer 8 shown in FIG. 2 is replaced with a speaker unit 23, wherein the low-pitch sound produced by the bass drum is transmitted to the speaker unit 23 in which a cone-shaped paper 24 is vibrated so that a voice coil 25 vibrates in a magnetic circuit formed by a magnet 26, whereby electric signals are produced through electromagnetic conversion and are transmitted to an external device (not shown) via the socket 20 and the connector 21.

That is, this invention is characterized by arranging an electroacoustic transducer arranged inside of the shell 2, wherein when the speaker unit 23 is used as shown in FIG. 3, it is possible to directly vibrate the cone-shaped paper 24 by forming the stretched diaphragms using mesh-like materials or porous materials, whereby it is possible to produce electric signals having a high fidelity with the original sound.

Incidentally, the sound pickup device of this invention is not necessarily applied to the bass drum; hence, it is applicable to other types of drums such as the floor-tam (also known as a floor-tom) and tam-tam (also known as a tom-tom), wherein as similar to the aforementioned embodiment in which the sound pickup device is adapted to the bass drum, the diaphragm of the sound pickup device is arranged opposite to the drumhead of the drum and is adjusted to cope with acoustics of the drum in the desired frequency range, for example.

As described heretofore, this invention realizes a high-fidelity sound pickup operation for the original sound produced by a percussion instrument such as a bass drum being played; hence, it is possible to produce electric signals well simulating the low-pitch sound actually picked up; therefore, it is possible to reproduce the sound having a rich sound quality very similar to that of the original sound. Since this invention is designed using an electroacoustic transducer arranged inside of a shell, it is possible to reduce the overall exterior shape and size of the sound pickup device, which can be easily subjected to installation or setting without spoiling the view on stage performance and the like.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A sound pickup device for picking up sound from a physically separate percussion instrument, the percussion instrument having a drumhead with a surface area, the sound pickup device comprising:

a shell;

a vibrator arranged inside of the shell adapted to resonate in response to low frequency sound from the physically separate percussion instrument, the vibrator having a surface area related to the surface area of the physically separate percussion instrument drumhead so as to pick up low frequency sound;

an electroacoustic transducer arranged inside the shell, which is connected with the vibrator, the electrostatic transducer producing an electric signal representing at least the low frequency sound from the separate percussion instrument;

a first diaphragm made of a mesh material, stretched over an opening of the shell facing the vibrator, the sound from the physically separate percussion instrument passing through said first diaphragm and reaching the surface area of said vibrator; and a second diaphragm stretched over another opening of the shell, wherein the sound pickup device is placed facing said first diaphragm to the drumhead of the physically separate percussion instrument.

2. The sound pickup device according to claim 1, wherein the electroacoustic transducer comprises a magnetic transducer.

3. The sound pickup device according to claim 1, wherein the electroacoustic transducer comprises a speaker unit.

4. The sound pickup device according to claim 1, wherein said vibrator is a cone-shaped paper arranged inside of the shell.

5. A drum set including a plurality of percussion instruments, comprising:

a drum having a drumhead; and a sound pickup device as set forth in any of the preceding claims, wherein the sound pickup device is arranged in such a way that the vibrator faces the drumhead of the drum.

* * * * *

UNITED STATES PATENT AND TRADEMARK OFFICE

CERTIFICATE OF CORRECTION

PATENT NO. : 7,256,342 B2
APPLICATION NO. : 10/828192
DATED : August 14, 2007
INVENTOR(S) : Takashi Hagiwara et al.

It is certified that error appears in the above-identified patent and that said Letters Patent is hereby corrected as shown below:

Title Page; item (75);
Inventors, add "Russell Miller, Chatsworth, CA (US)"

Signed and Sealed this
Twenty-fourth Day of May, 2011

David J. Kappos

David J. Kappos
*Director of the United States Patent and Trademark Office*